US010544770B2

(12) United States Patent
Vukadinovic et al.

(10) Patent No.: US 10,544,770 B2
(45) Date of Patent: Jan. 28, 2020

(54) MECHA-HYDRAULIC ACTUATED INLET CONTROL VALVE

(71) Applicant: Woodward, Inc., Fort Collins, CO (US)

(72) Inventors: Vlade Vukadinovic, Aken (DE); Lars Huebner, Aken (DE)

(73) Assignee: Woodward, Inc., Fort Collins, CO (US)

( * ) Notice: Subject to any disclaimer, the term of this patent is extended or adjusted under 35 U.S.C. 154(b) by 34 days.

(21) Appl. No.: 16/015,903

(22) Filed: Jun. 22, 2018

(65) Prior Publication Data

US 2019/0003435 A1 Jan. 3, 2019

Related U.S. Application Data

(60) Provisional application No. 62/526,880, filed on Jun. 29, 2017.

(51) Int. Cl.
*F02D 31/00* (2006.01)
*F02M 59/46* (2006.01)
(Continued)

(52) U.S. Cl.
CPC ..... *F02M 59/464* (2013.01); *F02M 39/02* (2013.01); *F02M 41/042* (2013.01);
(Continued)

(58) Field of Classification Search
CPC ..... F02M 37/0029; F02M 37/0052; F02M 47/027; F02M 59/466; F02D 41/32; F02D 41/38; F02D 1/00
(Continued)

(56) References Cited

U.S. PATENT DOCUMENTS 2,007,197 A 7/1935 Olof
4,892,114 A 1/1990 Maroney et al.
(Continued)

FOREIGN PATENT DOCUMENTS

DE 19939452 3/2001
JP 2001-021059 1/2001
(Continued)

OTHER PUBLICATIONS

International Search Report and Written Opinion in International Application No. PCT/US2018/039779, dated Sep. 13, 2018, 13 pages.

*Primary Examiner* — John Kwon
(74) *Attorney, Agent, or Firm* — Fish & Richardson P.C.

(57) ABSTRACT

The subject matter of this specification can be embodied in, among other things, a fluid control device that includes a housing defining a plunger cavity in fluid communication with a fluid inlet and a fluid outlet, a valve having a shaft having a first end and a second end, and a stopper at the first end configured to block a fluid circuit between the fluid inlet and the fluid outlet in a first configuration of the inlet control valve and connect the fluid circuit in a second configuration of the inlet control valve, and a plunger configured for axial movement within the plunger cavity, defining a shaft cavity having an inner wall extending from an enclosed end to an open end in fluid communication with the fluid outlet, and configured to accommodate axial movement of the shaft within the shaft cavity.

23 Claims, 8 Drawing Sheets

(51) Int. Cl.

| | |
|---|---|
| ***F02M 39/02*** | (2006.01) |
| ***F02M 41/04*** | (2006.01) |
| ***F02M 59/02*** | (2006.01) |
| ***F02M 59/10*** | (2006.01) |
| ***F04B 7/02*** | (2006.01) |

(52) U.S. Cl.
CPC ..... *F02M 59/027* (2013.01); *F02M 59/102* (2013.01); *F04B 7/0225* (2013.01)

(58) Field of Classification Search
USPC ..... 123/357, 385, 387, 495, 496, 506; 137/87.03, 503
See application file for complete search history.

(56) References Cited

U.S. PATENT DOCUMENTS

| | | | | |
|---|---|---|---|---|
| 5,490,379 | A | 2/1996 | Wernberg et al. | |
| 5,556,263 | A * | 9/1996 | Jacobsen | A61M 5/142 417/490 |
| 5,711,145 | A | 1/1998 | Perkey | |
| 6,102,001 | A | 8/2000 | McLevige | |
| 6,238,014 | B1 * | 5/2001 | Tamai | B60T 8/365 303/119.2 |
| 6,786,702 | B2 | 9/2004 | Zagranski et al. | |
| 6,821,093 | B2 | 11/2004 | Zagranski et al. | |
| 7,007,452 | B1 | 3/2006 | Baryshnikov et al. | |
| 7,178,510 | B2 | 2/2007 | Askew et al. | |
| 2006/0032535 | A1 | 2/2006 | Madden | |
| 2012/0091375 | A1 * | 4/2012 | Suganuma | F16K 1/52 251/129.01 |
| 2018/0203029 | A1 * | 7/2018 | Hamasaki | G01N 35/10 |
| 2019/0234395 | A1 * | 8/2019 | Dotan | E21B 43/128 |
| 2019/0234454 | A1 * | 8/2019 | Oohira | B60T 8/4031 |

FOREIGN PATENT DOCUMENTS

| | | |
|---|---|---|
| JP | 2001-055132 | 2/2001 |
| JP | 2003-156170 | 5/2003 |
| JP | 2011-038524 | 2/2011 |
| WO | WO 88/05863 | 8/1988 |
| WO | WO 2011/003789 | 1/2011 |

* cited by examiner

MECHA-HYDRAULIC ACTUATED INLET CONTROL VALVE

CROSS-REFERENCE TO RELATED APPLICATION(S)

This application claims the benefit of priority to U.S. Provisional Patent Application Ser. No. 62/526,880, filed on Jun. 29, 2017, the contents of which are hereby incorporated by reference.

TECHNICAL FIELD

This instant specification relates to fluid control valves, more particularly, fluid-dampened inlet control valves.

BACKGROUND

In operation of a piston pump, an inlet control valve (ICV) opens a fuel inlet in the working volume during an intake stroke and resists a fuel back flow during a pump stroke. Accordingly, to achieve optimized flow efficiency the valve should open at the very beginning of the intake stroke and close at the end of the intake stroke (e.g., at the beginning of pumping stroke).

Some existing ICVs are designed to open at a predetermined pressure, sometimes referred to as a valve opening pressure (VOP), which is achieved by a spring that provides a defined amount of force. Thus, the opening of the valve is not directly dependent on valve movement (i.e., position), but rather on a fluid pressure in a pump element. Furthermore, these valves are designed to close when the pump stroke begins. In some prior designs, the closing of the valve is again driven by the pressure conditions in the pump element. Such techniques for controlling an ICV operation can lead to a number of unwanted problems, such as reduction in volumetric pump efficiency, slow ICV response, fluid cavitation (for example, due to slow response and/or backflow), and mechanical damage (e.g., caused by cavitation, valve bounce).

SUMMARY

In general, this document describes fluid control valves, more particularly, fluid-dampened inlet control valves.

In a first aspect, a fluid control device includes a housing defining a plunger cavity in fluid communication with a fluid inlet and a fluid outlet, a valve having a shaft having a first end and a second end, and a stopper at the first end configured to block a fluid circuit between the fluid inlet and the fluid outlet in a first configuration of the inlet control valve and connect the fluid circuit in a second configuration of the inlet control valve, and a plunger configured for axial movement within the plunger cavity, defining a shaft cavity having an inner wall extending from an enclosed end to an open end in fluid communication with the fluid outlet, and configured to accommodate axial movement of the shaft within the shaft cavity.

Various embodiments and include some, all, or none of the following features. The shaft and the inner wall can define a fluid passage from the open end to the enclosed end. The shaft cavity and the shaft can be configured such that the fluid passage has a predetermined cross-section. The fluid control device can include a biasing member configured to urge the valve toward the first configuration. The fluid control device can include a fluid seal between the plunger and a plunger cavity wall of the plunger cavity, wherein the seal can define a portion of the plunger cavity. The fluid control device can include an actuator configured to urge movement of the inlet control valve between the first configuration and the second configuration. The actuator can include a cam follower coupled to the plunger and configured to urge reciprocal axial movement of the plunger in response to rotation of a cam. The actuator can include a linkage connected to a crankshaft. The actuator can be one of an electromagnetic solenoid, an electromagnetic servo, or an electromagnetic motor coupled to the plunger and configured to urge reciprocal axial movement of the plunger in response to an electrical activation signal.

In a second aspect, a method of fluid control includes blocking, by a stopper at a first end of a shaft of a valve, a fluid circuit between a fluid inlet to a fluid outlet, wherein the valve is at a first position, moving a plunger axially within a plunger cavity from a first plunger position toward a second plunger position, wherein the shaft is arranged within a shaft cavity defined within the plunger between an enclosed end and an open end, reducing, by movement of the plunger toward the second plunger position, fluid pressure of a fluid within the shaft cavity between the shaft and the plunger, urging, by the reduced fluid pressure, axial movement of the shaft within the shaft cavity from a first valve position toward a second valve position, and unblocking, by the stopper based on axial movement of the shaft, the fluid circuit.

Various implementations can include some, all, or none of the following features. The method can include flowing fluid from the open end toward the enclosed end between the shaft and an inner wall of the shaft cavity, restoring fluid pressure within the shaft cavity between the shaft and the plunger, and stopping movement of the shaft relative to the plunger. The method can include moving the plunger axially within the plunger cavity toward the first plunger position, increasing, by movement of the plunger toward the first position, fluid pressure within the shaft cavity between the shaft and the plunger, urging, by the increased fluid pressure, axial movement of the shaft within the shaft cavity toward the first valve position, and blocking, by the stopper, the fluid circuit. The method can include flowing fluid from the shaft cavity toward the open end between the shaft and an inner wall of the shaft cavity, restoring fluid pressure within the shaft cavity between the shaft and the plunger, and stopping movement of the shaft relative to the plunger. The method can include urging, by a biasing force provided by a compliant member, movement of the valve toward the first valve position, wherein the reduced fluid pressure is sufficient to overcome the biasing force.

In a third aspect, an engine system includes a combustion chamber, a camshaft, a fuel rail, and a fluid control device having a housing defining a fluid inlet in fluid communication with the fuel rail, a fluid outlet in fluid communication with the combustion chamber and the plunger cavity, a valve having a shaft having a first end and a second end, and a stopper at the first end, configured to substantially block fluid flow from the fluid inlet to the fluid outlet in a first configuration of the inlet control valve and allow fluid flow from the fluid inlet to the fluid outlet in a second configuration of the inlet control valve, and a plunger configured to follow the camshaft and move axially within the plunger cavity, the plunger defining a shaft cavity having an inner wall extending from an enclosed end to an open end in fluid communication with the fluid outlet, and configured to accommodate axial movement of the shaft within the shaft cavity.

Various embodiments can include some, all, or none of the following features. The shaft and the inner wall can define a fluid passage from the open end to the enclosed end. The shaft cavity and the shaft can be configured such that the fluid passage has a predetermined cross-section. The engine system can include a biasing member configured to urge the valve toward the first configuration. The engine system can include a fluid seal between the plunger and a plunger cavity wall of the plunger cavity, wherein the seal can define a portion of the plunger cavity. The engine system can include an actuator configured to urge movement of the inlet control valve between the first configuration and the second configuration. The actuator can include a cam follower coupled to the plunger and configured to urge reciprocal axial movement of the plunger in response to rotation of a cam. The actuator can include a linkage connected to a crankshaft. The actuator can be one of an electromagnetic solenoid, an electromagnetic servo, or an electromagnetic motor coupled to the plunger and configured to urge reciprocal axial movement of the plunger in response to an electrical activation signal.

The systems and techniques described here may provide one or more of the following advantages. First, an inlet control valve can open and close early in the intake and pump strokes. Second, the inlet control valve can increase the volumetric efficiency of the pump. Third, the inlet control valve can reduce the formation of cavitation bubbles.

The details of one or more implementations are set forth in the accompanying drawings and the description below. Other features and advantages will be apparent from the description and drawings, and from the claims.

DETAILED DESCRIPTION

This document describes fluid control valves, more particularly, fluid-dampened inlet control valves (ICVs), and techniques for using such valves. In general, the operation of the ICVs described in this document are controlled through a fluid connection between the ICV and a plunger. Localized pressures developed by fluid encapsulated between the ICV and plunger and caused by relative motion of the ICV and plunger, as well as the transfer of motion between the ICV and plunger by viscous friction forces of the fluid, urge relative motion of the ICV and plunger. By means of this connection between the components, the timing of opening and closing events of an ICV at the beginning of intake and pump strokes can be improved, while still permitting the ICV to control volumetric flow.

Figure 1:
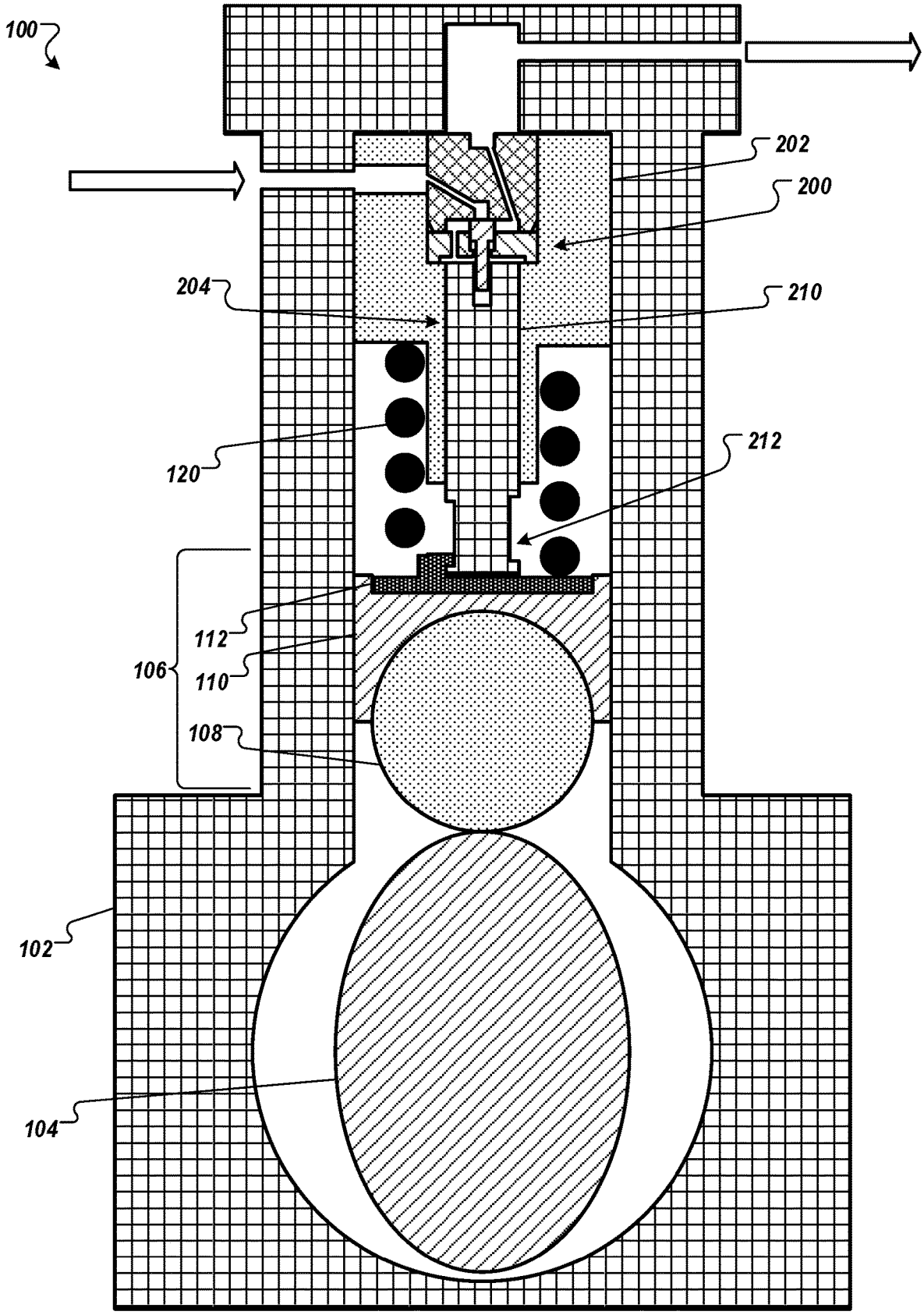
FIG. 1 is a cross-sectional diagram of an example of a system for fluid delivery that includes an example inlet control valve.

FIG. 1 is a cross-sectional diagram of an example of a system 100 for fluid delivery. In some embodiments, the system 100 can be part of a pumping mechanism. The system 100 includes an example ICV 200. In some embodiments, the ICV 200 can be used as a fluid control device.

The system 100 includes an outer housing 102. A camshaft 104 rotates within the outer housing 102. In some embodiments, the camshaft 104 can be rotated in synchronicity with a pumping mechanism. A cam follower 106 includes a roller 108, a bushing 110, and a bias plate 112. The bias plate 112 is urged away from a valve housing 202 of the ICV 200 by a compliant member 120 (e.g., a spring) to urge the cam follower 106 into contact with the camshaft 104. As the camshaft 104 rotates, the cam follower 106 is urged to move reciprocally (e.g., up and down in the illustrated example).

The bias plate 112 is removably coupled to a distal end 212 of a plunger 210 of the ICV 200. The plunger 210 is disposed within a plunger cavity 204 defined within the valve housing 202. The plunger 210 is configured to be urged in reciprocal axial movement within the plunger cavity 204 by the bias plate 112 as the cam follower 106 moves. In some embodiments, a seal may be disposed between a portion of the plunger 210 and the plunger cavity 204. In some embodiments, the plunger may be configured to be urged to move axially by an electromagnetic actuator (e.g., a solenoid, an electric motor) or some other form of mechanical actuator (e.g., a linkage connected to a crankshaft).

Figure 2:
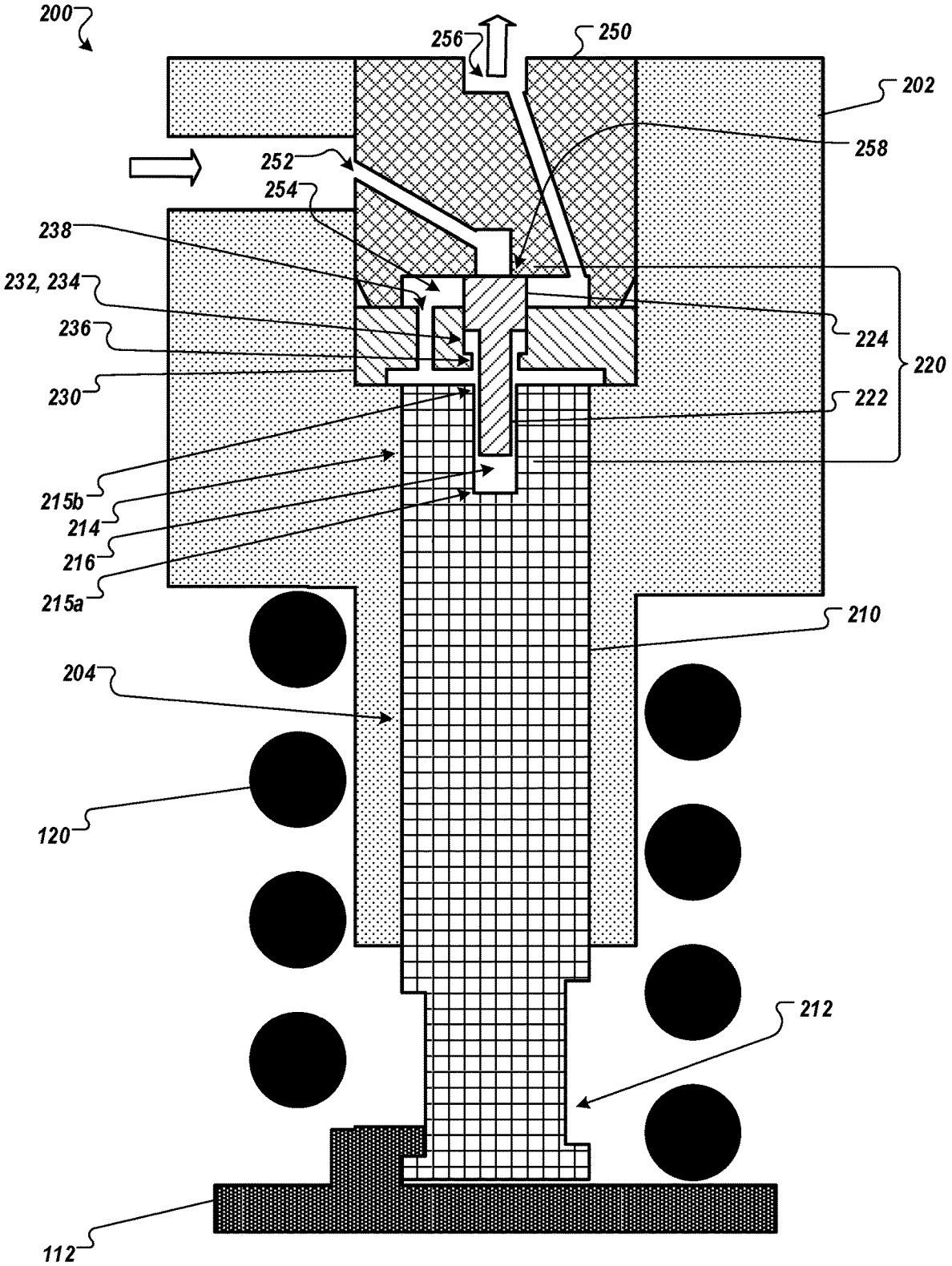
FIG. 2 is an enlarged cross-sectional diagram of the example inlet control valve of FIG. 1.

FIG. 2 is an enlarged cross-sectional diagram of the example inlet control valve (ICV) 200, the bias member 120, and the bias plate 112 of FIG. 1. The ICV 200 also includes a valve 220 that includes a shaft 222 with a stopper 224 at one end. In the illustrated example, the shaft 222 has a smaller cross section (e.g., diameter) than the stopper 224.

A shaft cavity 216 is defined within the plunger 210 at a proximal end 214, between an enclosed end 215*a* and an open end 215*b*. The shaft cavity 216 is sized to accommodate the shaft 222 such that the shaft 222 can move axially within the shaft cavity 216. The shaft cavity 216 is formed to be substantially aligned with (e.g., parallel to) the plunger cavity 214, such that the axial movement of the shaft 222 is substantially aligned with (e.g., parallel to) the axial movement of the plunger 210.

The ICV 200 includes a stopper plate 230. The stopper plate 230 defines a valve cavity 232 having a portion 234 sized to partly accommodate the stopper 224 (e.g., having a relatively large cross section) and another portion 236 differently sized to accommodate a portion of the shaft 222 (e.g., having a relatively smaller cross section than the portion 234). The stopper plate 230 also defines a fluid passage 238 extending through the body of the stopper plate 230. In some embodiments, the fluid passage 238 can be a portion of the valve cavity 232 (e.g., a gap around the stopper 224 and the shaft 222).

The valve 220 is arranged to controllably permit and block (e.g., stop, prevent) a fluid circuit defined in a valve head 250. It should be noted that any references to the valve 220 blocking, stopping, closing, preventing flow are to be understood as being practical within typical mechanical capabilities and manufacturing tolerances (e.g., blocking the fluid circuit can include substantially blocking the fluid circuit). The fluid circuit extends from an inlet 252, to a chamber 254, to an outlet 256. The stopper 224 is disposed within the chamber 254 to controllably open and close the fluid connection between the inlet 252 and the chamber 254. The stopper 224 is configured to move axially to a first position in which the stopper 224 at least partly contacts a seat 258 of the valve head 250 and substantially blocks fluid from flowing from the inlet 252 to the chamber 254. As the stopper 224 is moved axially away from the seat 258, a fluid (e.g., fuel) is able to flow from the inlet 252 to the chamber 254. Fluid in the chamber 254 is able to flow the shaft cavity 216 as well as the outlet 256, as will be described in more detail below in reference to FIGS. 3A-3E.

FIGS. 3A-3E are further enlarged cross-sectional diagrams of the example inlet control valve (ICV) 200 of FIGS. 1 and 2 at various stages of an operational cycle. The housing 202 has been omitted from FIGS. 3A-3E for ease of viewing.

Figure 3A:
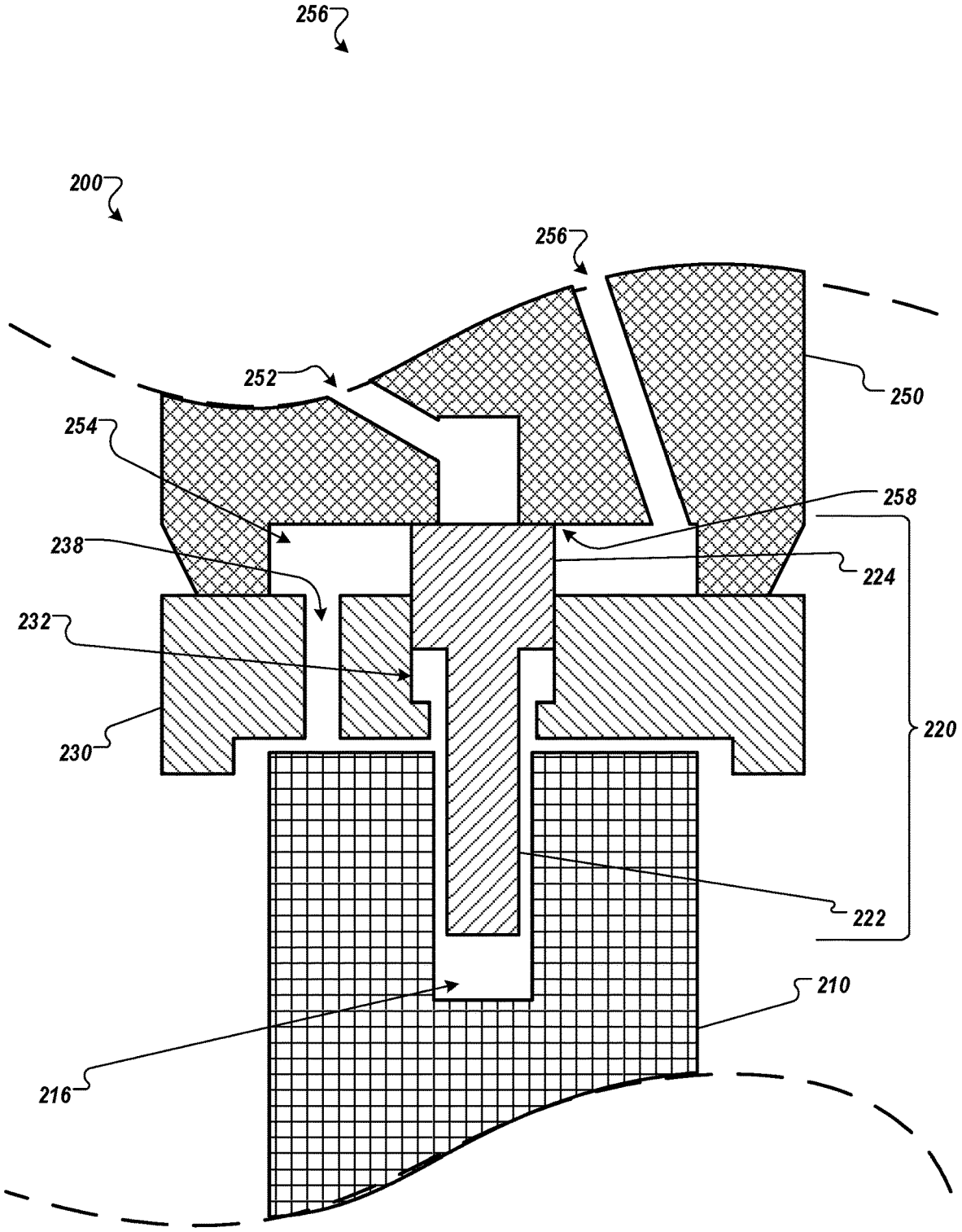
FIGS. 3A-3E are further enlarged cross-sectional diagrams of the example inlet control valve of FIGS. 1 and 2 at various stages of an operational cycle.

Referring first to FIG. 3A, the ICV 200 is shown in the same configuration as in FIGS. 1 and 2. In the illustrated example, the stopper 224 is in a first position in which the stopper 224 at least partly contacts the seat 258 of the valve head 250 and substantially blocks fluid from flowing from the inlet 252 to the chamber 254.

Figure 3B:
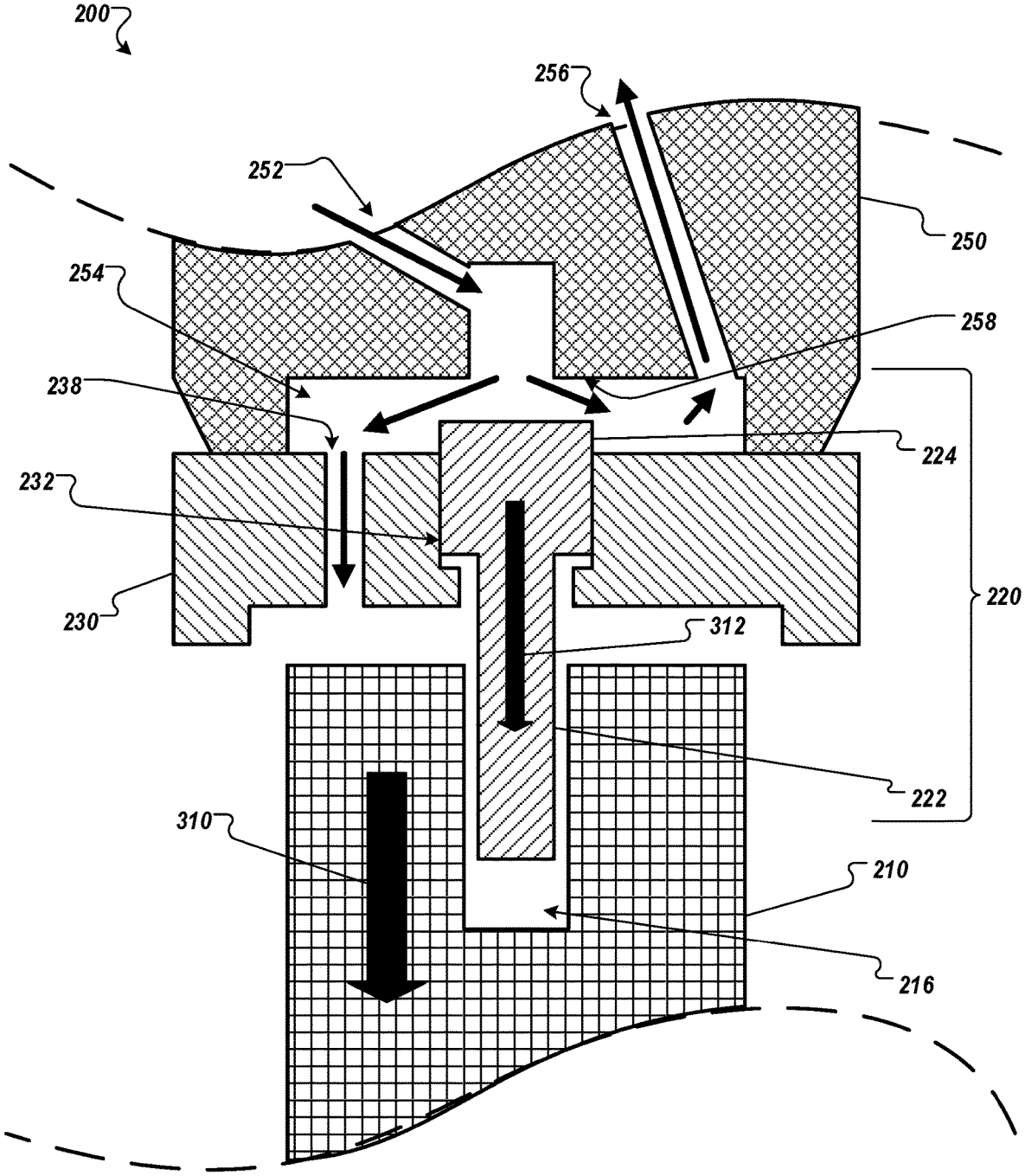

Referring now to FIG. 3B, the plunger 210 is moved axially away from the stopper plate 230 (e.g., by movement of the example cam follower 106) as indicated by arrow 310. Fluid occupies the shaft cavity 216, between the plunger 210 and the shaft 222. As the plunger 210 moves axially away from the stopper plate 230, the pressure of the fluid in the shaft cavity 216 decreases and draws the valve 220 axially in the same direction as the plunger 210, as indicated by arrow 312. Viscous frictional forces of the fluid in the shaft cavity 216 also contribute to drawing the valve 220 in the same direction as the plunger 210.

As the valve 220 moves axially, the stopper 224 moves away from the seat 258, unblocking the inlet 252 to allow fluid to flow through the inlet 252 into the chamber 254. A portion of the fluid flows to and out through the outlet 256, and a portion of the fluid flows to the fluid passage 238.

Figure 3C:
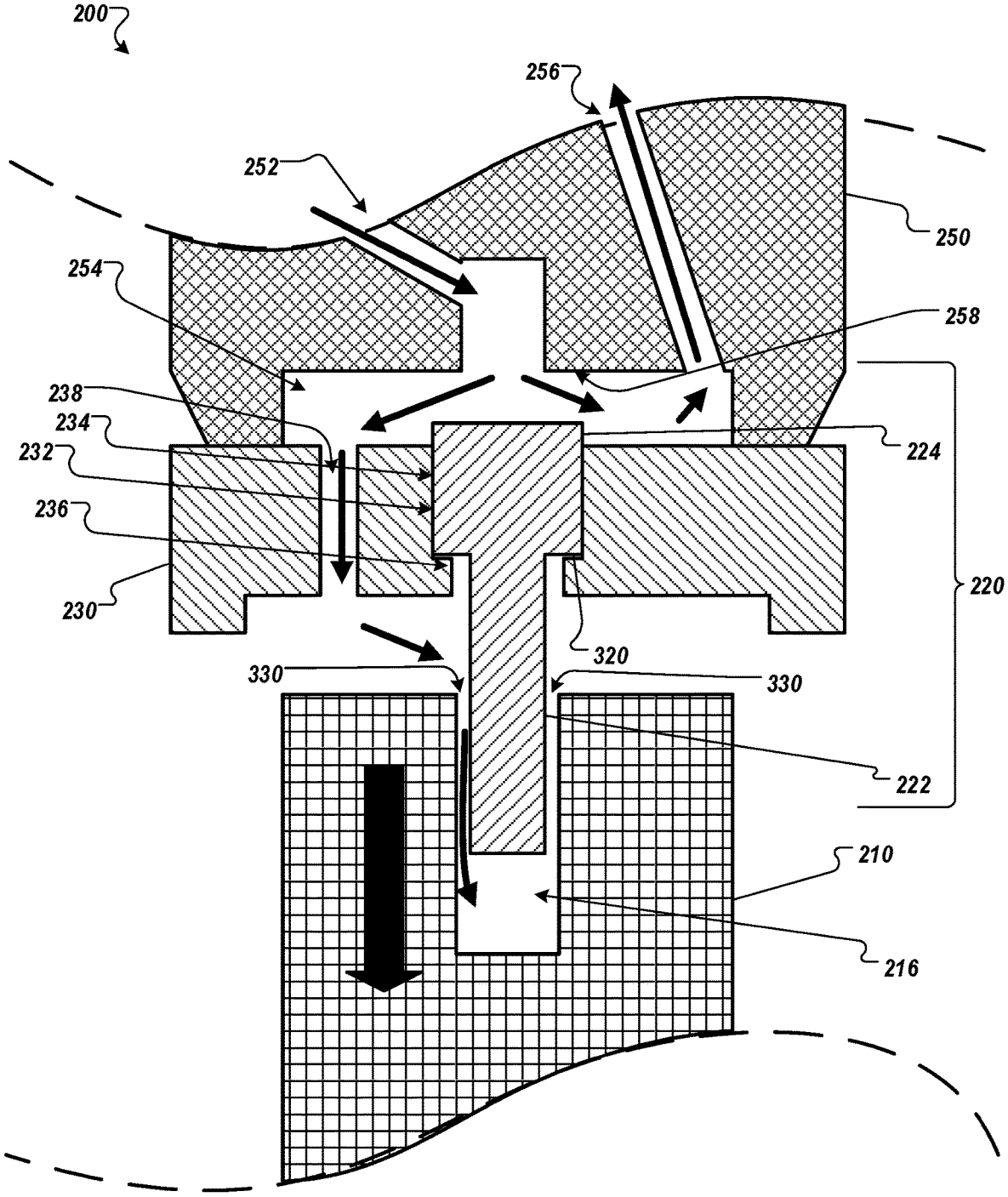

Referring now to FIG. 3C, the plunger 210 is moved axially further away from the stopper plate 230. The valve 220 is shown at a fully open position in which the stopper 224 is in contact with a hard stop 320 defined at the junction between the portion 234 and the portion 236. As such, the stopper 224 is stopped from axially following the plunger 210.

As the plunger 210 continues to move axially, the amount of open space within the shaft cavity 216 between the shaft 222 and the plunger 210 increases. Fluid from the fluid passage 238 is drawn into the shaft cavity 216 along a lateral gap 330 defined between the shaft 222 and the wall of the shaft cavity 216. For example, the shaft 222 can be formed with a predefined cross-section that is smaller than the predefined cross-section of the shaft cavity 216, such that the shaft 222 fits within the shaft cavity 216 with a predefined loose tolerance that allows fluid to pass.

The gap 330 provides a physical restriction that reduces the rate of fluid flow between the fluid passage 238 and the shaft cavity 216. This restriction and reduced rate of flow through the gap 330 provides a fluid damping function between the movement of the plunger 210 and the movement of the valve 220. For example, the valve 220 will follow the plunger 210, albeit with lesser speed and force than that of the plunger 210.

Figure 3D:
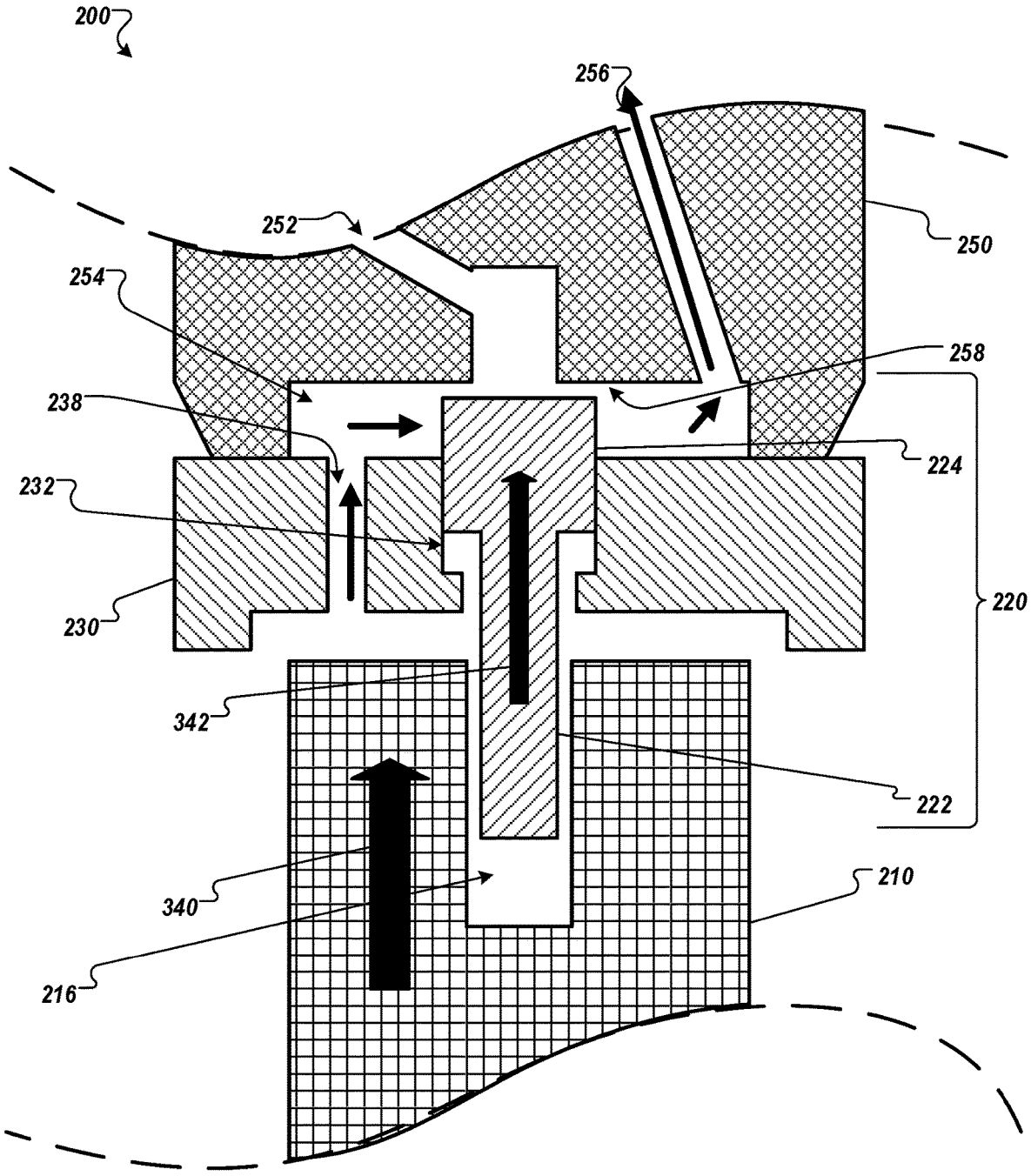

Referring now to FIG. 3D, the plunger 210 is moved axially toward the stopper plate 230 (e.g., by movement of the example cam follower 106) as indicated by arrow 340. Fluid occupies the shaft cavity 216, between the plunger 210 and the shaft 222. As the plunger 210 moves axially toward the stopper plate 230, the pressure of the fluid in the shaft cavity 216 increases and urges the valve 220 axially in the same direction as the plunger 210, as indicated by arrow 342. Viscous frictional forces of the fluid in the shaft cavity 216 also contribute to urging the valve 220 in the same direction as the plunger 210.

Figure 3E:
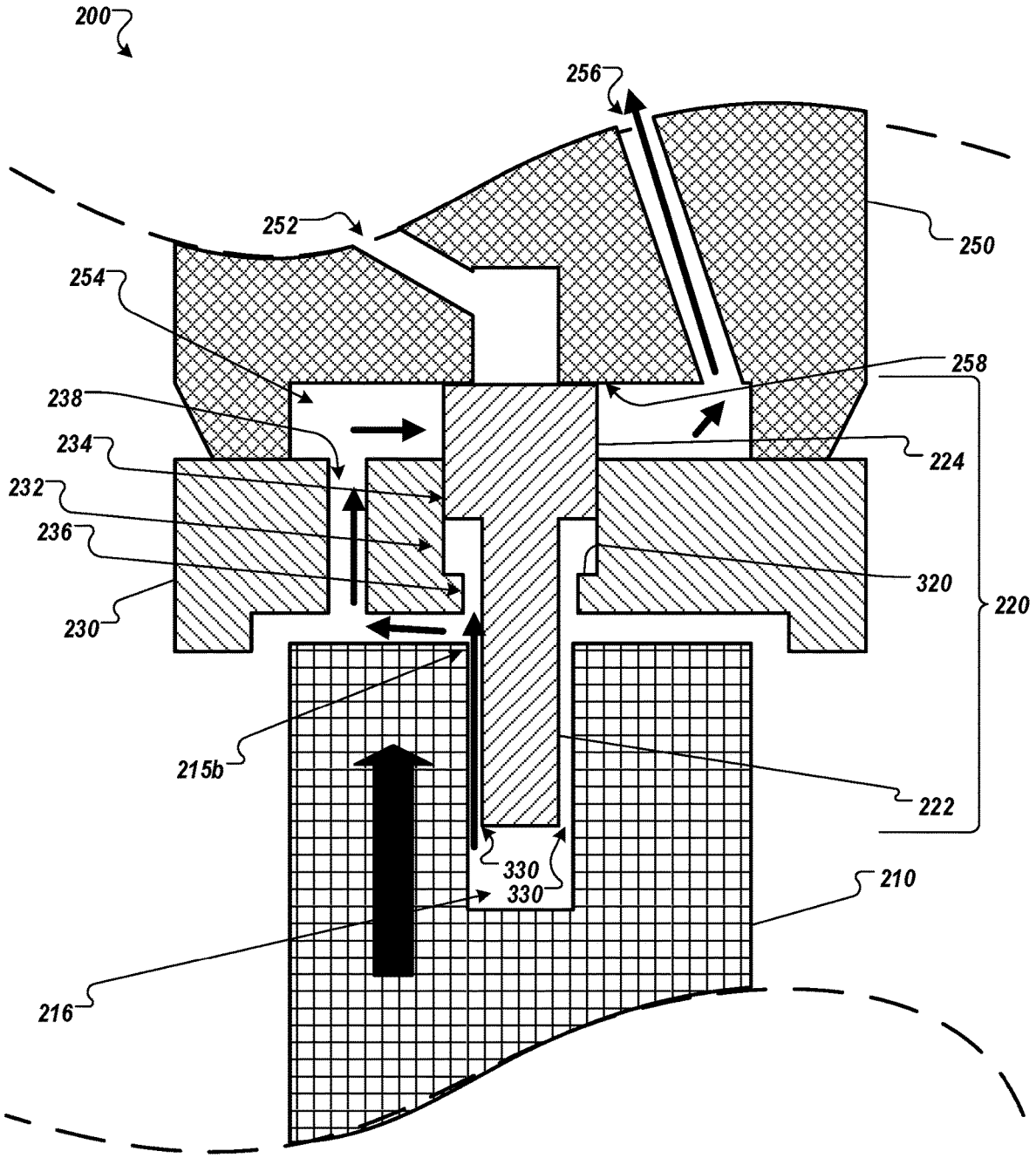

Referring now to FIG. 3E, the plunger 210 is moved axially further toward the stopper plate 230. The valve 220 is shown at a fully seated position in which the stopper 224 is in contact with the seat 258 defined at the junction between the portion 234 and the portion 236. As such, the stopper 224 is stopped from axially following the plunger 210.

As the plunger 210 continues to move axially, the amount of open space within the shaft cavity 216 between the shaft 222 and the plunger 210 decreases. Fluid in the shaft cavity 216 is urged out of the shaft cavity 216 along the lateral gap 330 toward the fluid passage 238, into the chamber 254, and out the outlet 256. Backflow of the fluid to the inlet 252 is prevented by the valve 220, which is seated against the seat 258.

As was discussed above, the valve 220 and the plunger 210 are linked hydraulically, such that the valve 220 at least partly follows the plunger 210 axially as the plunger 210 is moved axially. Fluid leakage along the gap 330 provides a damping effect in the movement of the valve 220 relative to the plunger 210. In some embodiments, the damping effect can soften impacts when the stopper 224 contacts the seat 258 and/or the hard stop 320. In some embodiments, the damping effect can reduce the occurrence of fluid cavitation. For example, when localized pressures of a liquid decline to some point below the saturated vapor pressure, bubbles can form. These bubbles can subsequently implode and cause shockwaves that can incrementally damage nearby mechanical parts. The damping effect of the valve 220 reduces the acceleration of the valve 220 through the surrounding fluids, thereby reducing the amount of localized depressurization of the fluid and reducing or eliminating the occurrence of cavitation that can happen as a result.

Figure 4:
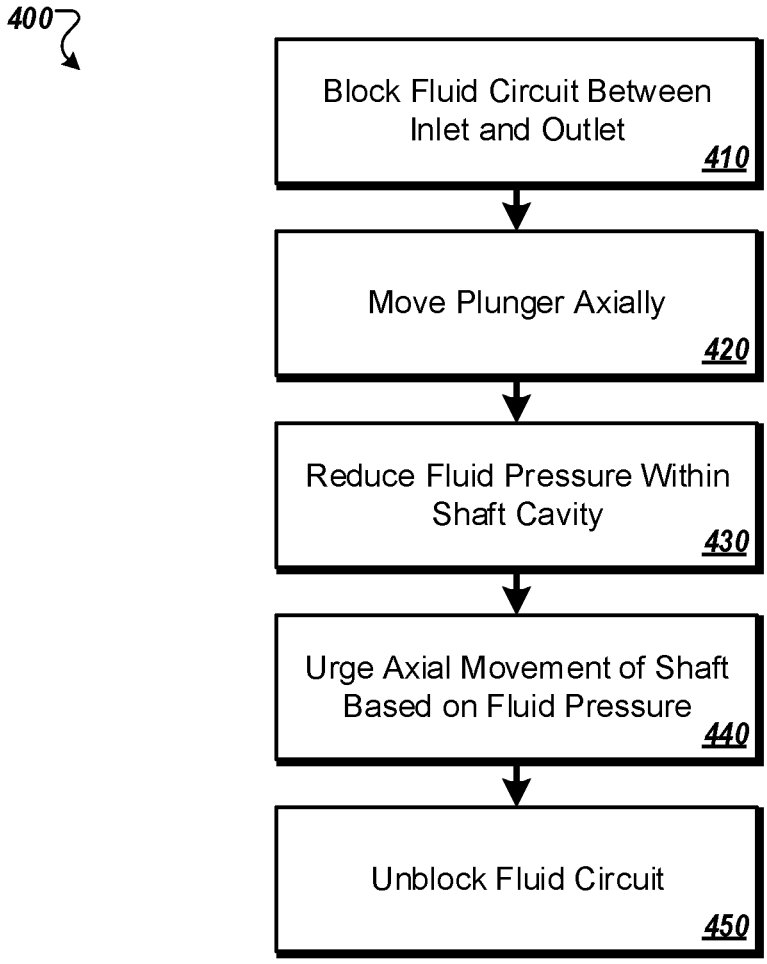
FIG. 4 is flow chart that shows an example of a process for controlling fluid flow using an example inlet control valve.

FIG. 4 is flow chart that shows an example of a process 400 for controlling fluid flow using an example inlet control valve, such as the example ICV 200 of FIGS. 1-3E.

At 410, a stopper at a first end of a shaft of a valve at a first position blocks a fluid circuit between a fluid inlet to a fluid outlet. For example, FIG. 3A shows the example stopper 224 blocking the inlet 252 from the chamber 254 and the outlet 256 at the seat 258.

At 420, a plunger moves axially within a plunger cavity from a first plunger position toward a second plunger position, wherein the shaft is partly arranged within a shaft cavity defined within the plunger between an enclosed end and an open end. For example, FIG. 3B shows the example plunger 210 moving axially away from the stopper plate 230, and the shaft 222 is partly disposed within the shaft cavity 216, which as shown in FIG. 2, extends between the enclosed end 215*a* and the open end 215*b*.

At 430, fluid pressure of a fluid within the shaft cavity between the shaft and the plunger is reduced by movement of the plunger toward the second plunger position. For example, in FIG. 3B, the pressure of fluid occupying the example shaft cavity 216 will drop as the example plunger 210 moves away from the example valve 220.

At 440, axial movement of the shaft within the shaft cavity from a first valve position toward a second valve position is urged by the reduced fluid pressure. For example, the shaft 222 of the example valve 220 is drawn away from the position shown in FIG. 3A, toward the positions shown in FIGS. 3B and 3C. In some embodiments, viscous frictional forces of the fluid in the shaft cavity 216 also urge the valve 220 to move in the same direction as the plunger 210.

At 450 the fluid circuit is unblocked by the stopper based on axial movement of the shaft. For example, referring to FIGS. 3B and 3C, the stopper 224 moves away from the seat 258, allowing fluid to flow from the inlet 252 to the chamber 254 and the outlet 256.

In some implementations, the process 400 can also include flowing fluid from the open end toward the enclosed end between the shaft and an inner wall of the shaft cavity, restoring fluid pressure within the shaft cavity between the shaft and the plunger, and stopping movement of the shaft relative to the plunger. For example, FIG. 3C shows that fluid can flow along the gap from the open end 215*b* toward the enclosed end 215*a*. This flow can rebalance the fluid pressures being exerted on the top side (e.g., in the chamber 254 upon the stopper 224) and the bottom side (e.g., in the shaft chamber 216 upon the shaft 222) of the valve 220. With the pressures rebalanced, the motion of the valve 220 relative to the plunger 210 will substantially stop.

The process 400 can also include moving the plunger axially within the plunger cavity toward the first plunger position, increasing, by movement of the plunger toward the first position, fluid pressure within the shaft cavity between the shaft and the plunger, urging, by the increased fluid pressure, axial movement of the shaft within the shaft cavity toward the first valve position, and blocking, by the stopper, the fluid circuit. For example, FIG. 3D shows the plunger 210 moving axially toward the stopper plate 230. Relative motion of the plunger and the valve 220 can cause the pressure of the fluid in the shaft cavity 216 to increase and urge movement of the shaft 222 of the valve 220 toward the stop 258. In FIG. 3E, the stopper 224 of the valve 220 has been moved into contact with the stop 258, substantially blocking the fluid connection between the inlet 252 and the chamber 254.

In some implementations, the process 400 can also include flowing fluid from the shaft cavity toward the open end between the shaft and an inner wall of the shaft cavity, restoring fluid pressure within the shaft cavity between the shaft and the plunger, and stopping movement of the shaft relative to the plunger. For example, FIG. 3E shows that fluid can flow along the gap 330 from the shaft cavity 216 toward the open end 215*b*.

In some implementations, the process 400 can also include urging, by a biasing force provided by a compliant member, movement of the valve toward the first valve position, wherein the reduced fluid pressure is sufficient to overcome the biasing force. For example, the ICV 200 can include a spring, magnet, elastic member, or any other appropriate source of biasing force between the stopper 224 and the hard stop 320, or within the shaft chamber 216 between the enclosed end 215*a* and the shaft 222, in which the spring is configured to urge the stopper 224 away from the hard stop 320 and toward the seat 258. In such examples, the valve 220 would open the inlet 252 to the chamber 254 only when hydraulic forces caused by the relative motion of the plunger 210 and the shaft 222 were large enough to overcome the biasing force of the spring.

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A fluid control device comprising:

a housing defining a plunger cavity in fluid communication with a fluid inlet and a fluid outlet;

a valve comprising:

a shaft having a first end and a second end; and a stopper at the first end, configured to block a fluid circuit between the fluid inlet and the fluid outlet in a first configuration of the inlet control valve and connect the fluid circuit in a second configuration of the inlet control valve; and a plunger configured for axial movement within the plunger cavity, defining a shaft cavity having an inner wall extending from an enclosed end to an open end in fluid communication with the fluid outlet, and configured to accommodate axial movement of the shaft within the shaft cavity.

2. The fluid control device of claim 1, wherein the shaft and the inner wall define a fluid passage from the open end to the enclosed end.

3. The fluid control device of claim 2, wherein the shaft cavity and the shaft are configured such that the fluid passage has a predetermined cross-section.

4. The fluid control device of claim 1, further comprising a biasing member configured to urge the valve toward the first configuration.

5. The fluid control device of claim 1, further comprising a fluid seal between the plunger and a plunger cavity wall of the plunger cavity, wherein the seal defines a portion of the plunger cavity.

6. The fluid control device of claim 1, further comprising an actuator configured to urge movement of the inlet control valve between the first configuration and the second configuration.

7. The fluid control device of claim 6, wherein the actuator comprises a cam follower coupled to the plunger and configured to urge reciprocal axial movement of the plunger in response to rotation of a cam.

8. The fluid control device of claim 6, wherein the actuator comprises a linkage connected to a crankshaft.

9. The fluid actuator of claim 6, wherein the actuator is one of an electromagnetic solenoid, an electromagnetic servo, or an electromagnetic motor coupled to the plunger and configured to urge reciprocal axial movement of the plunger in response to an electrical activation signal.

10. A method of fluid control comprising:

blocking, by a stopper at a first end of a shaft of a valve, a fluid circuit between a fluid inlet to a fluid outlet, wherein the valve is at a first position;

moving a plunger axially within a plunger cavity from a first plunger position toward a second plunger position, wherein the shaft is arranged within a shaft cavity defined within the plunger between an enclosed end and an open end;

reducing, by movement of the plunger toward the second plunger position, fluid pressure of a fluid within the shaft cavity between the shaft and the plunger;

urging, by the reduced fluid pressure, axial movement of the shaft within the shaft cavity from a first valve position toward a second valve position; and unblocking, by the stopper based on axial movement of the shaft, the fluid circuit.

11. The method of claim 10, further comprising:

flowing fluid from the open end toward the enclosed end between the shaft and an inner wall of the shaft cavity;

restoring fluid pressure within the shaft cavity between the shaft and the plunger; and stopping movement of the shaft relative to the plunger.

12. The method of claim 10, further comprising:

moving the plunger axially within the plunger cavity toward the first plunger position;

increasing, by movement of the plunger toward the first position, fluid pressure within the shaft cavity between the shaft and the plunger;

urging, by the increased fluid pressure, axial movement of the shaft within the shaft cavity toward the first valve position; and blocking, by the stopper, the fluid circuit.

13. The method of claim 12, further comprising:

flowing fluid from the shaft cavity toward the open end between the shaft and an inner wall of the shaft cavity;

restoring fluid pressure within the shaft cavity between the shaft and the plunger; and stopping movement of the shaft relative to the plunger.

14. The method of claim 10, further comprising urging, by a biasing force provided by a compliant member, movement of the valve toward the first valve position, wherein the reduced fluid pressure is sufficient to overcome the biasing force.

15. An engine system comprising:

a combustion chamber;

a camshaft;

a fuel rail; and a fluid control device comprising:

a housing defining a fluid inlet in fluid communication with the fuel rail;

a fluid outlet in fluid communication with the combustion chamber and the plunger cavity;

a valve comprising:

a shaft having a first end and a second end; and a stopper at the first end, configured to substantially block fluid flow from the fluid inlet to the fluid outlet in a first configuration of the inlet control valve and allow fluid flow from the fluid inlet to the fluid outlet in a second configuration of the inlet control valve; and a plunger configured to follow the camshaft and move axially within the plunger cavity, the plunger defining a shaft cavity having an inner wall extending from an enclosed end to an open end in fluid communication with the fluid outlet, and configured to accommodate axial movement of the shaft within the shaft cavity.

16. The engine system of claim 15, wherein the shaft and the inner wall define a fluid passage from the open end to the enclosed end.

17. The engine system of claim 16, wherein the shaft cavity and the shaft are configured such that the fluid passage has a predetermined cross-section.

18. The engine system of claim 15, further comprising a biasing member configured to urge the valve toward the first configuration.

19. The engine system of claim 15, further comprising a fluid seal between the plunger and a plunger cavity wall of the plunger cavity, wherein the seal defines a portion of the plunger cavity.

20. The engine system of claim 15, further comprising an actuator configured to urge movement of the inlet control valve between the first configuration and the second configuration.

21. The engine system of claim 20, wherein the actuator comprises a cam follower coupled to the plunger and configured to urge reciprocal axial movement of the plunger in response to rotation of a cam.

22. The engine system of claim 20, wherein the actuator comprises a linkage connected to a crankshaft.

23. The engine system of claim 20, wherein the actuator is one of an electromagnetic solenoid, an electromagnetic servo, or an electromagnetic motor coupled to the plunger and configured to urge reciprocal axial movement of the plunger in response to an electrical activation signal.

* * * * *